US006595395B2

(12) United States Patent
Jourdin et al.

(10) Patent No.: US 6,595,395 B2
(45) Date of Patent: Jul. 22, 2003

(54) DISPENSER HAVING A FIXING MEMBER, AND A FIXING MEMBER FOR SUCH A DISPENSER

(75) Inventors: Gilles Jourdin, Combon (FR); Dany Ray, Juziers (FR)

(73) Assignee: Valois S.A., Le Neubourg (FR)

( * ) Notice: Subject to any disclaimer, the term of this patent is extended or adjusted under 35 U.S.C. 154(b) by 108 days.

(21) Appl. No.: 09/867,810

(22) Filed: May 30, 2001

(65) Prior Publication Data

US 2001/0054624 A1 Dec. 27, 2001

Related U.S. Application Data

(63) Continuation-in-part of application No. 09/776,178, filed on Feb. 2, 2001.

(30) Foreign Application Priority Data

May 31, 2000 (FR) ..... 00.07018
Feb. 9, 2001 (FR) ..... 01.02022

(51) Int. Cl.[7] ..... B67D 5/40
(52) U.S. Cl. ..... 222/321.9
(58) Field of Search ..... 222/321.1, 321.7, 222/321.8, 321.9, 570, 385, 402.1; 215/274, 275, 277, 316, 317, 321; 220/780, 309.1, 309.2, 315, 319

(56) References Cited

U.S. PATENT DOCUMENTS

| | | | |
|---|---|---|---|
| 746,329 | A | 12/1903 | Hicks |
| 822,099 | A | 5/1906 | Byrnes |
| 1,060,369 | A | 4/1913 | Schwenck |
| 1,327,963 | A | 1/1920 | Ramsey |
| 1,478,141 | A | 12/1923 | Orr |
| 1,504,698 | A | 8/1924 | Merolle |
| 1,605,228 | A | 11/1926 | Hammer |

(List continued on next page.)

FOREIGN PATENT DOCUMENTS

| | | |
|---|---|---|
| DE | 346781 | 7/1960 |
| DE | 2007597 | 9/1971 |
| EP | 0 997 397 A1 | 5/2000 |
| GB | 681240 | 10/1952 |
| IT | 357306 | 3/1938 |

OTHER PUBLICATIONS

Rapport De Recherche Préliminaire for French patent application FR 00.07018 filed May 31, 2000.

*Primary Examiner*—Ehud Gartenberg
*Assistant Examiner*—Patrick Buechner
(74) *Attorney, Agent, or Firm*—Wood, Phillips, Katz, Clark & Mortimer

(57) ABSTRACT

A fluid dispenser is provided with a dispenser member, a container (1) with a neck (10), and a fixing member (2) for fixing the fluid dispenser member to the neck of the container. The fixing member comprises a skirt (20) defining an inside wall. The fluid dispenser has an inside wall provided with at least two longitudinal ribs (23) extending over the height of the skirt. The ribs (23) cooperate by plastic deformation with an outside portion (11) of the neck (10).

14 Claims, 4 Drawing Sheets

U.S. PATENT DOCUMENTS

| | | | | |
|---|---|---|---|---|
| 1,609,078 | A | | 11/1926 | Floyd et al. |
| 1,634,724 | A | | 7/1927 | Ramsey |
| 1,677,253 | A | | 7/1928 | Scofield |
| 1,720,835 | A | | 7/1929 | Holmdahl |
| 2,064,042 | A | | 12/1936 | Von Till |
| 2,109,805 | A | | 3/1938 | Stewart |
| 2,281,649 | A | | 5/1942 | Williams |
| 2,790,576 | A | | 4/1957 | Lawrence |
| 2,947,432 | A | | 8/1960 | Marcel |
| 2,971,663 | A | | 2/1961 | Tevander et al. |
| 2,998,893 | A | | 9/1961 | Thomas |
| 3,085,705 | A | | 4/1963 | Varney |
| 3,360,156 | A | | 12/1967 | Bohlman |
| 3,371,813 | A | | 3/1968 | Owen et al. |
| 3,396,866 | A | | 8/1968 | Oppasser |
| 3,618,802 | A | | 11/1971 | Yates, Jr. |
| 3,814,278 | A | | 6/1974 | Beierle |
| 3,869,057 | A | | 3/1975 | Miller |
| 4,230,230 | A | | 10/1980 | Munford |
| 4,257,526 | A | | 3/1981 | Weits et al. |
| 4,300,701 | A | | 11/1981 | Santostasi |
| 4,494,674 | A | | 1/1985 | Roof |
| 4,709,825 | A | | 12/1987 | Mumford |
| 4,717,034 | A | | 1/1988 | Mumford |
| 4,721,219 | A | | 1/1988 | Dullabaun et al. |
| 4,828,130 | A | | 5/1989 | Hofmann |
| 4,911,316 | A | | 3/1990 | Tackles |
| 5,139,164 | A | | 8/1992 | Steward |
| 5,147,059 | A | | 9/1992 | Olsen et al. |
| 5,147,074 | A | | 9/1992 | Battegazzore |
| 5,301,852 | A | * | 4/1994 | Mancini ..... 222/321.9 |
| 5,562,219 | A | | 10/1996 | de Pous |
| 5,657,895 | A | | 8/1997 | Rogge |
| 5,692,628 | A | | 12/1997 | Montgomery et al. |
| 5,799,810 | A | | 9/1998 | de Pous et al. |
| 5,836,468 | A | | 11/1998 | Bösl et al. |
| 5,927,531 | A | | 7/1999 | Kuzma et al. |
| 6,056,144 | A | | 5/2000 | Strange et al. |
| 6,206,246 | B1 | * | 3/2001 | Bougamont et al. ..... 222/321.9 |

* cited by examiner

DISPENSER HAVING A FIXING MEMBER, AND A FIXING MEMBER FOR SUCH A DISPENSER

CROSS REFERENCE TO RELATED APPLICATION

This is a continuation-in-part of U.S. patent application Ser. No. 09/776,178 filed Feb. 2, 2001.

TECHNICAL FIELD

The present invention relates to a dispenser for dispensing a fluid, the dispenser comprising a dispenser member such as a pump or a valve, a container forming a neck, and a fixing member for fixing the dispenser member to the neck of the container. The present invention also relates to such a fixing member. The fixing member comprises a skirt defining an inside wall serving to co-operate with the neck of the container.

BACKGROUND OF THE INVNETION

Such dispensers using such fixing members are in common use for dispensing fluids in the fields of perfumes, or cosmetics, or indeed pharmaceuticals.

Several types of fixing member commonly designated by the term "fixing ring" are known from the prior art. In general, such a ring defines a skirt that extends downwards and that serves to co-operate with a reinforced portion formed by the neck of the container. The reinforced or thickened portion may be referred to as a "rim lip" and it projects outwards and forms a downwardly-facing shoulder. The skirt of the ring is provided with a continuous snap-fastening bead or with separate snap-fastening heads serving to come into engagement under the shoulder formed by the rim lip. The skirt is split and can be continuous or split to form tabs at the ends of which the snap-fastening heads are formed. When the skirt forms tabs and snap-fastening heads, a trim band is generally provided that fits over and covers the skirt so as to lock the snap-fastening heads under the shoulder of the rim lip. When the skirt is continuous and forms a continuous inside snap-fastening bead, the trim band is not necessary and is then purely decorative.

In both cases, regardless of whether the skirt is continuous or split, the snap-fastening bead or the snap-fastening heads co-operate with the shoulder of the rim lip. The skirt does not interact in any way with the cylindrical outside bearing surface of the rim lip in a fixing purpose.

Unfortunately, regardless of whether it is split or not, such a skirt is easily deformed due to the bead or the heads being engaged under the shoulder of the rim lip by force. When the skirt has snap-fastening tabs provided with heads, this plastic deformation of the skirt occurs under the effect of the trim band while said band is being mounted. When the skirt is continuous and provided with a continuous inside snap-fastening bead, the deformation of the skirt is sometimes visible from the outside.

SUMMARY OF THE INVENTION

An object of the present invention is to remedy the above-mentioned drawbacks of the prior art by defining a fixing member whose skirt is not subject to any deformation on its outside, and which can also perform effective fixing without using the trim band to lock it on the neck of the container.

To this end, the present invention proposes that the inside wall be provided with at least two longitudinal ribs extending over the height of the skirt, said ribs co-operating by plastic deformation with an outside portion of the neck.

Unlike the snap-fastening head or bead situated under the shoulder of the rim lip and therefore co-operating only with said shoulder, the ribs of the preferred embodiments of the invention extend over the height of the rim lip, and advantageously also under the rim lip so that the skirt is in contact with the neck over a large fraction of the height of the skirt.

In an embodiment, the ribs define an inside diameter smaller than the outside diameter of the neck before the fixing member has been mounted on the neck so that the ribs are deformed plastically over an outside bearing surface of the neck after said fixing member has been mounted on said neck. Since the ribs extend longitudinally, and since they are spaced apart from one another, they can be deformed plastically over the rim lip of the neck relatively easily without damaging or deforming the outside wall of the skirt.

In another embodiment, the reinforced portion or rim lip is provided with at least one retaining notch into which the ribs penetrate by plastic deformation.

Advantageously, said at least one notch extends around the periphery of the reinforced portion.

The notch or the notches may, for example, be in the form of one or more circular grooves formed in the substantially cylindrical outside bearing surface of the rim lip. Naturally, it is possible to consider any shape for the outside profile of the bearing surface of the rim lip that makes it possible to improve the fastening of the ribs by plastic deformation. The term "notch" is thus used to designate any surface state of the outside bearing surface of the rim lip that makes it possible to improve the retention of the fixing member.

In a variant, said at least one notch extends over the height of the reinforced portion, said notch having a width smaller than the width of a rib so that the rib is held by plastic deformation in said notch. In which case, the notch is not peripheral but rather it is vertical, extending through the rim lip of the neck. Advantageously, the notch has a width that tapers from the top end of the neck. The notch is preferably wider than the rib at the top end of the neck and necessarily narrower than the rib at its bottom end. This makes is possible firstly to facilitate inserting the rib into the notch, and secondly to retain the rib in the notch by a barb effect.

It is also possible to consider a split skirt having tabs, on the insides of which the ribs are formed. In which case, the fixing member further comprises a trim band which covers the skirt at least in part. Since the ribs can be deformed without deforming the outside wall of the skirt, the trim band can be mounted on the fixing member before it is mounted on the neck of the container. Thus, the fixing member and the band can be mounted as a single unit on the neck of the container.

According another aspect of the invention, the skirt comprises longitudinal inner recesses located radially outwardly of the ribs in the thickness of the skirt, so that the ribs may be deformed radially outwardly into their respective recesses without deforming the outer surface or wall of the skirt. These recesses allow a deformation of the inner ribs without affecting the outer surface or wall of the skirt. It is therefore possible to pre-mount a trim band on the skirt. The trim band may advantageously be in contact with the outer wall of the skirt on the entire periphery, and therefore also at the level of the inner recesses. Of course, the expression "inner recesses" means that the recesses do not open at the outer wall of the skirt which may therefore remain cylindrical. Preferentially, the recesses open or emerge at the level of the lower end of the skirt and are therefore shaped as blind holes extending axially in the thickness of the skirt wall from its lower end. And in order to enhance a good elastical deformation of the ribs, it is advantageous for the recesses to be larger than the ribs.

The present invention is described more fully below with reference to the accompanying drawings which give three embodiments of the present invention by way of non-limiting example.

DETAILED DESCRIPTION OF THE PREFERRED EMBODIMENTS

Figure 1A:
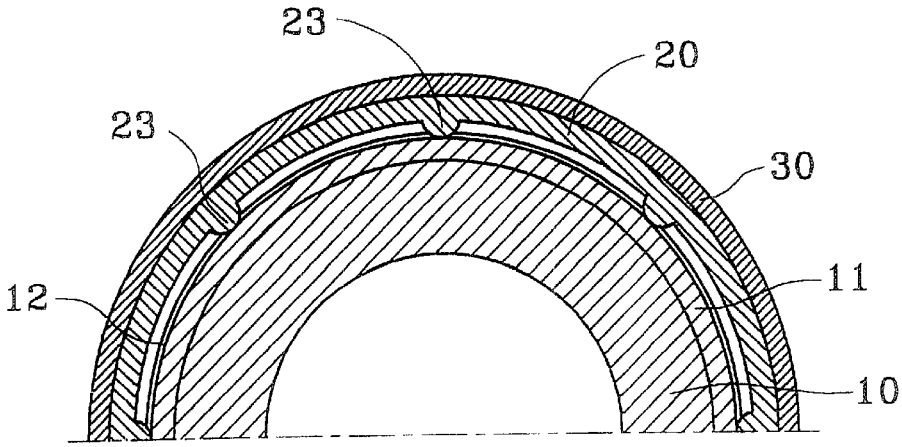
FIG. 1*a* is a bottom half view of a fixing member according a first embodiment of the invention.
Figure 1B:
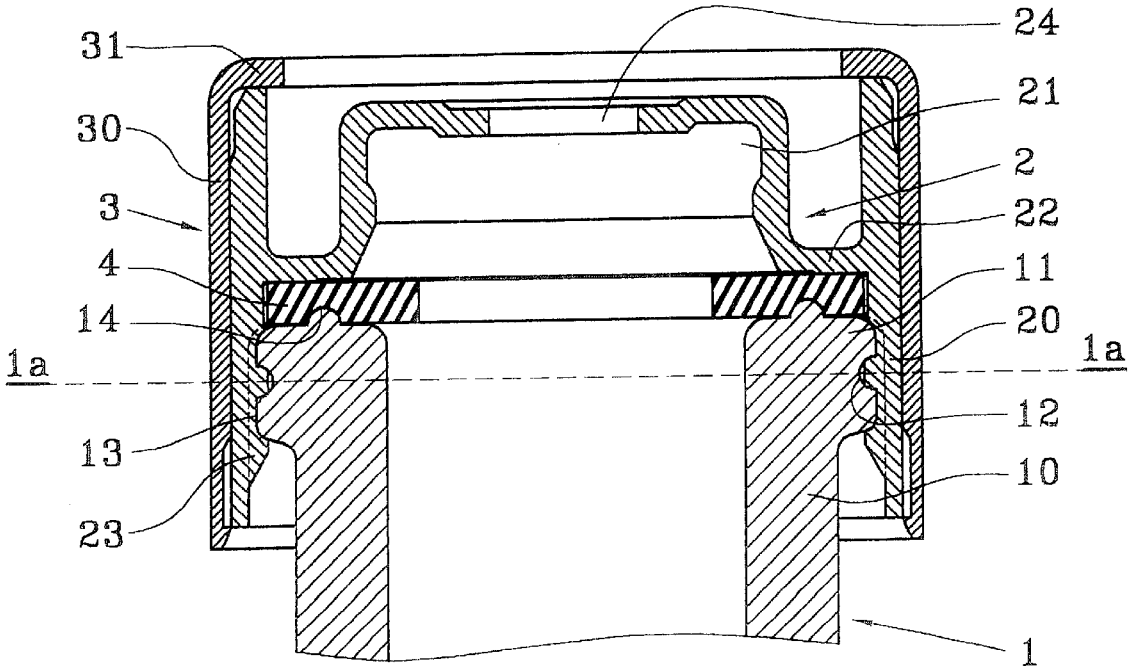
FIG. 1*b* is a vertical cross-section view through the fixing member of FIG. 1*a*, as mounted on a container neck.

Reference is made firstly to FIGS. 1*a* and 1*b* to explain a first embodiment. The fixing member comprises a ring 2 that is made of a molded plastics material, for example, and that forms a recess 21 serving to receive a dispenser member (not shown) such as a valve or a pump which is snap-fastened thereto by force. In general, the body of the valve or of the pump has a reinforced collar suitable for being snap-fastened in the recess 21. The actuating rod for actuating the valve or the pump passes through an opening 24 provided in the ring 2. The periphery of the recess 21 is connected to a web 22 serving to come into bearing contact on a gasket 4 interposed between the web 22 and the top end of the neck of a container 1. The web 22 is connected via its outside periphery to a skirt 20 which is essentially cylindrical in outside shape. The skirt 20 extends downwards from the web 22 and may also extend upwards as shown in FIG. 1*b*. In its downwardly-extending portion, the skirt 20 co-operates with a neck 10 of the container 1. The neck advantageously has a thickened or reinforced portion 11 that projects outwardly and that may be referred to as a "rim lip" 11. The rim lip 11 extends to the top end of the neck 10, and a sealing bead 14 over which the flexible gasket 4 is deformed is provided on said top end of the neck 10. The rim lip 11 extends downwards over some distance and then forms a shoulder so as to connect to the smaller-diameter cylindrical portion of the neck.

In the invention, the inside wall of the skirt 20 is provided with a plurality of ribs 23 that extend vertically over a fraction of the height of the skirt 20. In the embodiment shown in FIGS. 1*a* and 1*b*, there are eight such ribs 23 distributed uniformly around the inside periphery of the inside wall of the skirt 20. The ribs 23 advantageously extend over a height greater than the height of the rim lip 11. It is also possible to consider embodiments in which ribs extend over a height that is substantially equal to or slightly less than the height of the rim lip.

In the invention, the ribs 23 define a virtual cylinder including the ends of the ribs. This virtual cylinder has a diameter that is smaller than the outside diameter of the rim lip 11 so that, once the skirt 20 is mounted on the neck 10 of the container 1, the ribs 23 are deformed plastically against the substantially cylindrical outside bearing surface of the rim lip 11. In order to ensure that the ribs are held more securely to the rim lip, they may advantageously extend to below the shoulder of the rim lip so as to fit snugly over said shoulder, thereby contributing to fastening the skirt to the neck. It is also possible to provide the outside bearing surface of the rim lip 11 with a profile enabling the ribs to be fastened more securely. As shown in FIG. 1*b*, the outside bearing surface of the rim lip 11 is provided with an annular notch 12 which extends around all or some of the periphery of the rim lip. It is also possible to provide a plurality of notches of this type. Thus, the ribs can penetrate by plastic creep into the notches, and thus improve the fastening of the skirt 20 onto the neck 10. When the rim lip 11 is provided with such notches, the ribs do not need to extend to below the shoulder of the rim lip. In other words, the ring can be fastened to the neck without the skirt co-operating with the shoulder of the rim lip, unlike the fastening in the above-mentioned prior art. A shaped outside bearing surface on the rim lip suffices to hold the ribs of the skirt effectively on the neck. Since the ribs are disposed separately and constitute only localized reinforcements in the direction in which the ring is inserted onto the neck, said ribs can be deformed without deforming the outside wall of the skirt 20.

It should be noted that the skirt 20 is fastened to the neck without needing a trim band 3 such as the band shown in FIG. 1*b* and serving in prior art fixing members to lock the snap-fastening heads under the shoulder of the rim lip. In this embodiment, the trim band 3 is purely decorative and can be pre-mounted on the ring 2 before said ring is mounted on the neck of the container. This is made possible by the fact that the plastic deformation of the ribs does not give rise to any deformation of the outside wall of the skirt 20. In certain applications, it is thus possible to omit the trim band 3.

Figure 3B:
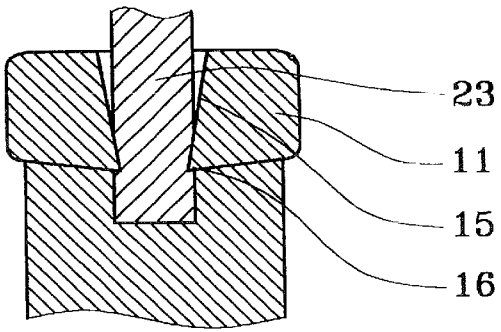
FIG. 3*b* is a vertical section view taken along plane 3*b*—3*b* in FIG. 2.
Figure 3A:
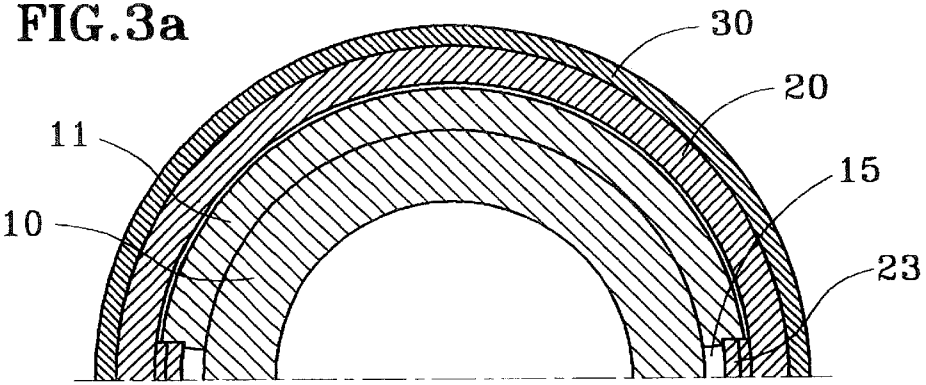
FIG. 3*a* is a horizontal section view through the fixing member and the neck taken along plane 3*a*—3*a* in FIG. 2.
Figure 2:
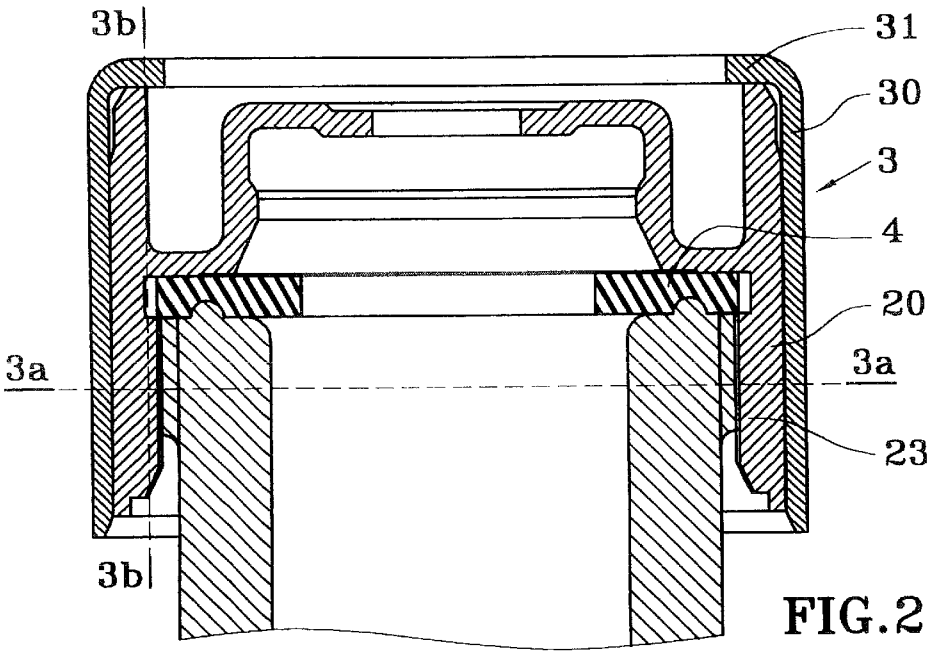
FIG. 2 is a vertical cross-section view through a fixing member and a container neck in a second embodiment.

Reference is made below to FIGS. 2, 3*a*, and 3*b* in order to explain a second embodiment of the invention. In this embodiment, the ring 20 is also provided with ribs 23 that extend vertically over a fraction of the height of the skirt. As in the preceding embodiment, these ribs 23 co-operate with the rim lip 11 of the neck 10 of the container. In the invention, a plurality of vertical notches may be formed in the rim lip 11. Such a notch may extend from top to bottom of the rim lip so that said rim lip is interrupted at the notch, but the notch may also extend over a fraction only of the height of the rim lip starting from its top end while leaving the bottom end of the rim lip uninterrupted. In the embodiment used to illustrate the present invention, the notch 15 extends right through the rim lip. FIG. 3*a* shows that the rim lip 11 is provided with two notches of this type. Naturally, it is possible to provide more than two notches of this type, e.g. distributed uniformly around the periphery of the neck. In the invention, the ribs 23 (of which there are also two) formed on the skirt 20 are suitable for fitting into the notches 15 in the rim lip. Advantageously, the notches 15 in the rim lip are of width smaller than the width of the ribs 23 so that the ribs 23 are deformed plastically against the edges of the notches 15. Preferably, the width of the notches 15 tapers from the top end of the neck, so that, at the top end of the neck, the width of the notches is larger than the width of the ribs, and so that, at the bottom end of the notches, the width of the notches is smaller than the width of the ribs 23. Thus, the ribs 23 can be force inserted into the notches 15. As can be seen in FIG. 3*b*, it is advantageous for the sloping edges of the notches 15 to form barb profiles 16, e.g. situated at the bottom ends of the notches 15. It is also possible to consider notch shapes in which one or more barb profiles is/are formed on each of the edges of the notches elsewhere than at their bottom ends. Whereas in the embodiment shown in FIGS. 1*a* and 1*b*, the ribs are deformed radially, in this second embodiment shown in FIGS. 2, 3*a*, and 3*b*, the ribs are deformed tangentially by the edges of the notches 15. With such vertical notches 15, the fastening of the skirt 20 is locked both vertically and in rotation. It is impossible to remove the fixing member from the neck because of the presence of the barb profiles 16 formed by the rim lip 11. It is thus guaranteed that the ring is fastened securely and irreversibly to the neck.

It should be noted that the trim band 3 may also be pre-mounted before the ring is mounted on the neck, since the deformation of the ribs does not give rise to any deformation of the outside wall of the skirt 20.

In both of the embodiments, use is made of ribs that are formed on the inside of the skirt. These ribs are deformable plastically, e.g. by creep taking place over fastening profiles formed by the neck which is not necessarily provided with a rim lip. The deformation of the ribs may be radial or tangential.

Figure 4:
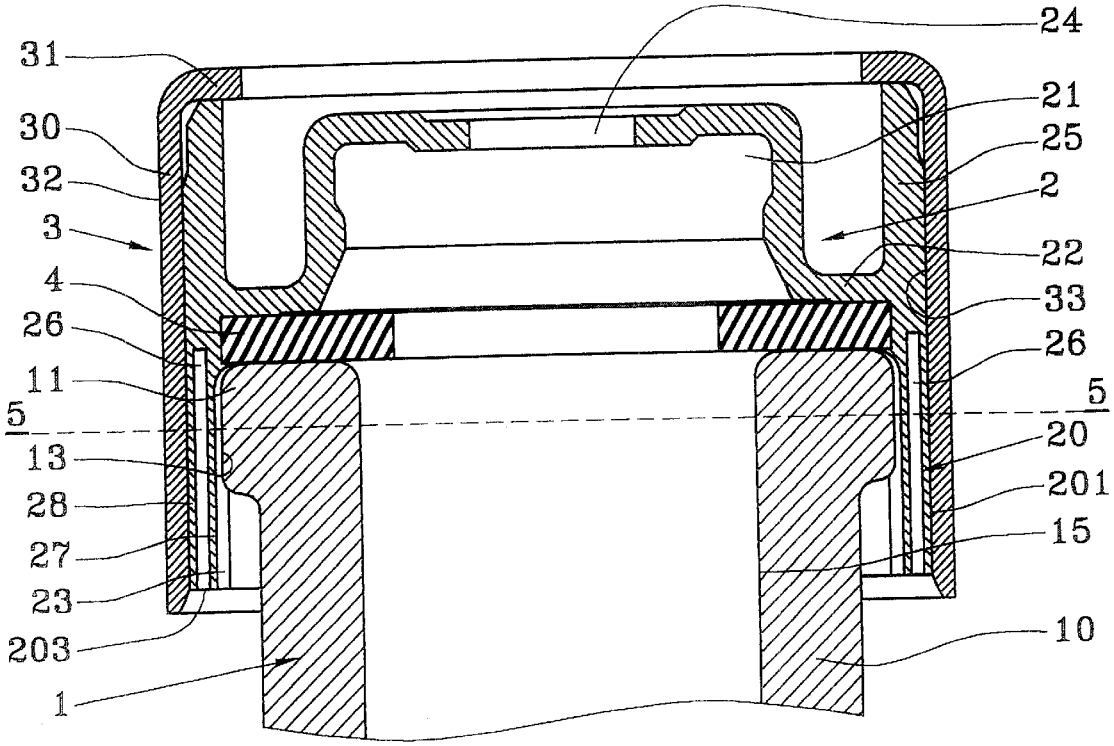
FIG. 4 is a vertical cross-section view through a fixing device according to a third embodiment.
Figure 5:
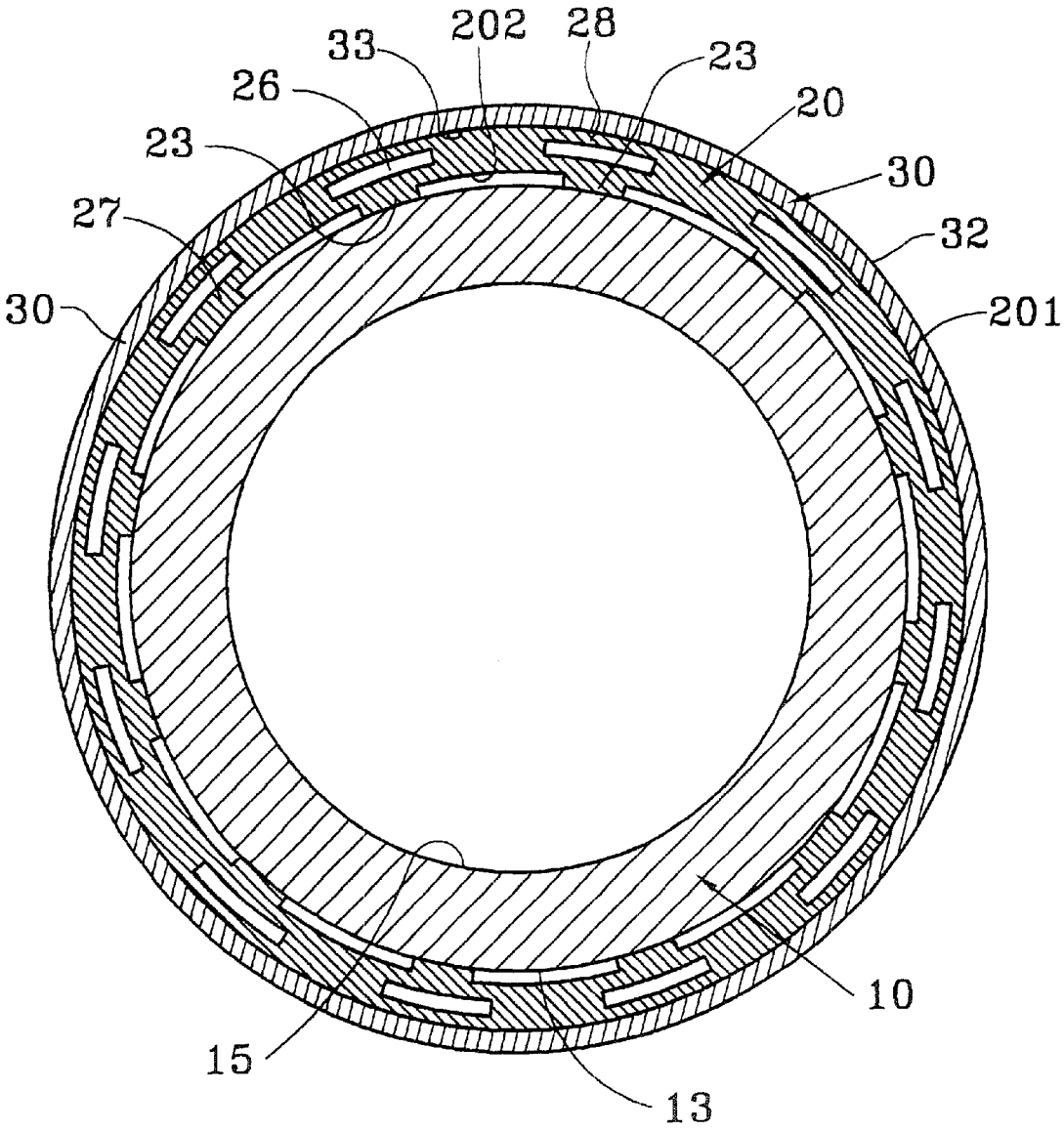
FIG. 5 is a horizontal cross-section view through the fixing device taken along plane 5—5 in FIG. 4.

The third embodiment shown in FIGS. 4 and 5 is an alternative of the first embodiment of FIGS. 1*a* and 1*b*. The skirt 20 of the fixing device is here formed with longitudinal inner recesses 26 extending throughout the height of the skirt. These recesses 26 are internal, since they do not emerge either on the inner wall 202 or on the outer wall 201. They extend from the lower end 203 of the skirt 20 upwardly and are shaped as blind holes emerging on the lower end 203 of the skirt and extending upwardly axially through the thickness of the wall of the skirt without interfering with the inner wall (i.e., inner surface) or outer wall (i.e., outer surface) of the skirt. These recesses may, for instance, be formed with a pin penetrating into the mould from the lower end of the skirt.

As it may be seen on FIG. 5, the recesses 26 are separated from the outer wall 201 by wall sections 28 and from the inner wall 202 by other wall sections 27, and longitudinal inner ribs 23 are formed on these wall sections 27. Therefore, a recess 26 is always associated with a rib 23, and the rib is located radially inwardly of the recess. In other words, the recesses 26 are located just behind the ribs 23 when looking from the center of the fixing device, so that the ribs may be deformed radially outwardly in their respective recesses, particularly during their mounting on the neck of the container. During that deformation of the ribs 23, only the wall sections 27 are deformed whereas the wall sections 28 remain totally non deformed. The outer wall 201 of the skirt 20 is not deformed during the mounting of the ring on a container neck. It is therefore possible to mount a trim or decorative band 3 on the ring before mounting the ring on the container neck. The trim band 3, comprising a substantially cylindrical body 30 with an outer wall 32 and an inner wall 33 and an inwardly extending upper rim 31, may be in contact with the outer wall 201 of the skirt on the whole of its periphery, as it may be seen on FIG. 5. The fixing device may be mounted on a neck with the trim band 3 mounted on the ring 2 as represented on FIG. 4.

Advantageously, the recesses 26 are larger than the ribs 23.

The ribs 23 may for example be deformed radially inwardly in the recesses 26 at the level of the wall 13 of the neck 10. The ribs 23 may conform to the profile of the lower shoulder of the rim lip. It is to be noted that with these longitudinal ribs 23 extending advantageously on the whole of the height of the skirt, it is possible to realize a fixing on a neck with a rim lip 11 variable in height. That is not the case with the devices of the prior art using snap teeth or beads adapted to be received under that shoulder.

What is claimed is:

1. A dispenser for dispensing a fluid, the dispenser comprising a dispenser member, a container with a neck, and a fixing member for fixing the fluid dispenser member to the neck of the container, said fixing member comprising a skirt defining an inside wall, said inside wall being provided with at least two longitudinal ribs extending over the height of the skirt, said ribs co-operating by plastic deformation with an outside portion of the neck.

2. A fluid dispenser according to claim 1, in which the ribs define an inside diameter smaller than the outside diameter of the neck before the fixing member has been mounted on the neck so that the ribs are deformed plastically over an outside bearing surface of the neck after said fixing member has been mounted on said neck.

3. A fluid dispenser according to claim 1, in which the neck forms a reinforced portion of larger diameter and that projects outwards, the ribs co-operating with said reinforced portion.

4. A fluid dispenser according to claim 3, in which the ribs extend to below said reinforced portion.

5. A fluid dispenser according to claim 3, in which the reinforced portion is provided with at least one retaining notch into which the ribs penetrate by plastic deformation.

6. A fluid dispenser according to claim 5, in which said at least one notch extends around the periphery of the reinforced portion.

7. A fluid dispenser according to claim 5, in which said at least one notch extends over the height of the reinforced portion, said at lest one notch having a width smaller than the width of a rib so that the rib is held by plastic deformation in said notch.

8. A fluid dispenser according to claim 7, in which said at least one notch has a width that tapers from the top end of the neck.

9. A fluid dispenser according to claim 1, in which the fixing member further comprises a trim band which covers the skirt at least in part.

10. Fixing device for fixing a fluid product dispenser on a container neck, said device comprising a fixing ring defining a substantially cylindrical skirt having an outer wall, and an inner wall adapted to co-operate with an outer wall of the container neck, characterized in that the inner wall of the skirt is provided with longitudinal ribs extending through the height of the skirt, said ribs being adapted to engage the outer wall of the neck with a tight contact, the skirt comprises longitudinal inner recesses located radially outwardly of the ribs and extending in the thickness of the skirt, so that the ribs may be deformed radially outwardly in their respective recesses without deforming the outer wall of the skirt.

11. Fixing device according to claim 10, wherein the longitudinal recesses do not open on the outer wall of the skirt.

12. Fixing device according to claim 10, wherein the outer wall of the skirt is in contact with a trim band on its periphery.

13. Fixing device according to claim 10, wherein the recesses are larger than the ribs.

14. Fixing device according to claim 10, wherein the recesses are open at a lower end of the skirt and are formed as blind holes extending axially in the thickness of the skirt from its lower end between said outer and inner walls.

* * * * *